United States Patent [19]

Glans et al.

[11] 4,401,004

[45] Aug. 30, 1983

[54] ARRANGEMENT TO REDUCE THE THICKNESS OF A MOVING MATERIAL WEB

[75] Inventors: Jan-Erik Glans, Kävlinge; Arvid Mårtensson, Södra Sandby, both of Sweden

[73] Assignee: Tetra Pak International AB, Lund, Sweden

[21] Appl. No.: 230,045

[22] Filed: Jan. 29, 1981

[30] Foreign Application Priority Data

Feb. 5, 1980 [SE] Sweden ..... 8000890

[51] Int. Cl.[3] ..... B26D 3/06

[52] U.S. Cl. ..... 83/875; 83/98; 83/169; 83/171; 83/871; 493/60

[58] Field of Search ..... 83/871, 875, 876, 861, 83/98, 171, 169; 493/60

[56] References Cited

U.S. PATENT DOCUMENTS

| | | | |
|---|---|---|---|
| 2,228,442 | 1/1941 | Coleman | 83/861 X |
| 3,332,459 | 7/1967 | Gilmore | 83/876 X |
| 4,254,693 | 3/1981 | Schadowski et al. | 83/875 X |
| 4,295,263 | 10/1981 | Davis | 83/875 X |

*Primary Examiner*—Frank T. Yost

*Attorney, Agent, or Firm*—Burns, Doane, Swecker & Mathis

[57] ABSTRACT

In the manufacture of a packing container laminated packing material is used which with the help of a rotating cylindrical cutter is made thinner within a limited longitudinal region. This reduction of thickness has been difficult to realize up to now with the desirable accuracy, since the specified depth of cut that has been set may readily be influenced by vibrations in the moving material or in the cutter. These difficulties are overcome by a guiding device, arranged in the immediate vicinity of the edge of the cutter, which limits the thickness of the strip cut away. The guiding device is suspended in contact with the cutter in such a manner that not only are the vibrations reduced, but also the influence of the remaining vibrations on the depth of cut is minimized. The guide is adjustable to vary the depth of cut and includes air outlets for cooling the cutter and for guiding the cut strip away from the packing material.

11 Claims, 3 Drawing Figures

ARRANGEMENT TO REDUCE THE THICKNESS OF A MOVING MATERIAL WEB

BACKGROUND AND SUMMARY OF THE INVENTION

The present invention relates to an arrangement for reducing the thickness of a moving material web along a longitudinal region by cutting away a material strip by a rotating cylindrical cutter. The cutter is arranged on one side of the material web with its axis of rotation substantially in the direction of movement of the web.

In the packing industry a packing material which comprises layers, inter alia, of paper and thermoplastics is used for the manufacture of packing containers for e.g. liquid contents such as milk. In the conversion of the packing material to finished packing containers the longitudinal edges of the material are sealed to one another in an overlap joint. In order to avoid contact of the contents in the packing container with the centrally situated carrier layer of the material, the edge region of the material layer facing the inside of the packing container is folded double so that in the sealing the edge ends up inside and consequently cannot make contact with the contents. Even if the packing laminate has only a total thickness of approx. 0.4 mm, this double folding means that the material obtains an undesirable thickness in the sealing regions which is disadvantageous, especially when two sealing regions cross one another, since in that case channels which entail leakage can easily be produced.

In order to avoid this, it has been suggested that the thickness of the material should be reduced in a longitudinal region which corresponds to the edge region wherein the folding subsequently is to take place. This reduction of the thickness of the material web is done appropriately with the help of a rotating cylindrical cutter, which during the manufacture of the container is made to rest against the material web passing by, in such a manner that by means of the active part of its periphery it cuts off a strip of desired thickness from one side of the material web. The material web passing by can be provided in this manner with one or more longitudinal regions of reduced thickness at the edges of the material web or at those parts of the material web which after dividing up of the same into narrower material webs will form the edge regions.

The cutting away of a material strip with the help of a rotating cylindrical cutter can take place at very high web speeds, which is in fact necessary since the material web on the occasion during the manufacturing process where the reduction of thickness takes place, is fed through the manufacturing machines at a speed of over 300 m/minute. At this high speed a correspondingly high speed of the cylindrical cutter is required. The cutter's peripheral speed should be approx. 50 m/min. It is obvious that it is very difficult at such high working speeds to maintain an exact depth of cut of e.g. 0.25 mm, since this is influenced by inaccuracies in the material passing by, as well as by inaccuracies in the support and in the design of the rotating cylindrical cutter. It has indeed proved practically impossible to maintain a correct depth of cut under such conditions and with the means available up to now. Presently a guide pulley situated inside the rotating cylindrical cutter and freely rotatable in the direction of movement of the material is used. The distance to the cutting edge determines the thickness of the material strip cut off, and an air nozzle arranged at the same level as the cutting edge, but on the opposite side of the material web, is adapted so as to press the material web passing by against the guide pulley. In addition to the difficulties mentioned earlier concerning inaccuracies in the movement of the material web and in the support of the cutter, there are now also inaccuracies in the guide pulley which make the maintaining of a constant depth of cut even more difficult. Even if this were possible in itself immediately after an adjustment of the position of the cutting pulley and the rest of the interacting parameters, the accuracy would be lost after a short period of operation so that non-acceptable thickness variations would occur in the reduced region of the material web.

It is an object of the present invention, whilst retaining the basic construction of the arrangement, to design the different parts of the arrangement in such a manner that the cutting away of the material strip can take place with sufficient accuracy even during prolonged periods of operation.

It is a further object of the present invention to provide a simple and effective arrangement for the adjustment of the thickness of the strip cut away and hence of the thickness of the remaining material in the thickness-reduced region of the material web.

It is a further object of the present invention to provide an arrangement which can operate at especially high material speeds, in particular up to 600 m/min.

Finally it is an object also to provide an arrangement which is uncomplicated and stable as well as inexpensive to manufacture and to maintain.

These and other objects have been achieved in accordance with the invention by providing an arrangement for reducing the thickness of a moving material web along a longitudinal region by the cutting away of a material strip by means of a rotating cylindrical cutter which is arranged on one side of the material web with its axis of rotation substantially in the direction of movement of the web. A guiding device for the control of the thickness of the strip cut away is arranged close by the edge of the cylindrical cutter and is upheld by a supporting unit which is in contact with the cylindrical cutter.

Preferred embodiments of the arrangement in accordance with the invention have been given the further characteristics which are evident from the description below.

DESCRIPTION OF THE DRAWINGS

A preferred embodiment of the arrangement in accordance with the invention will now be described with special reference to the enclosed schematic drawings, which only show the details required for the understanding of the invention.

DESCRIPTION OF THE PREFERRED EMBODIMENT

Figure 1:
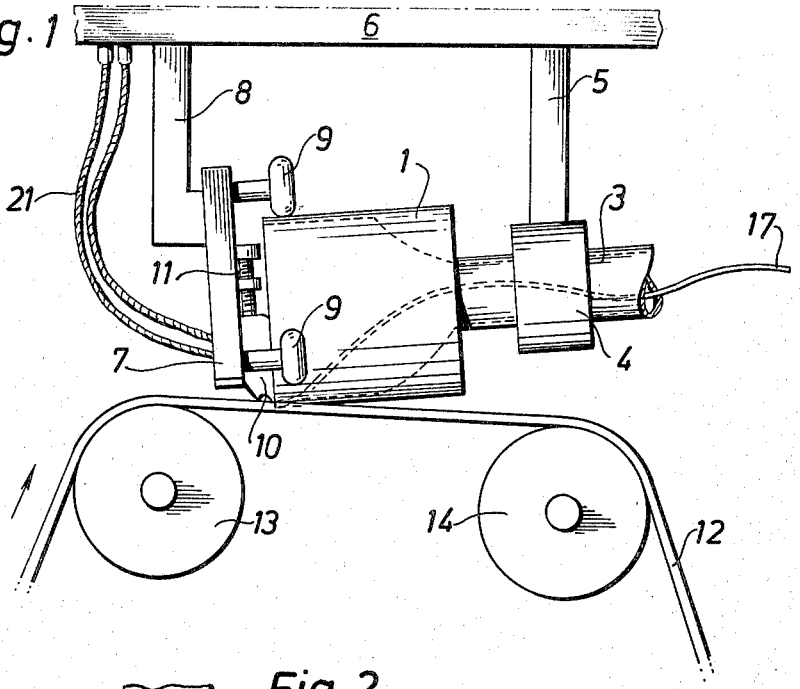
FIG. 1 is a side view an arrangement in accordance with the invention during the working of a passing material web.

With reference to FIG. 1, the arrangement in accordance with the invention comprises a cylindrical cutter 1 which on its one free end is ground to a cutting edge 2 extending around the whole circumference of the cylinder. The opposite end of the cylindrical cutter is in the form of a hollow cutter shaft 3, which is supported by means of a bearing 4 and a fastener 5 in a machine frame 6.

Figure 3:
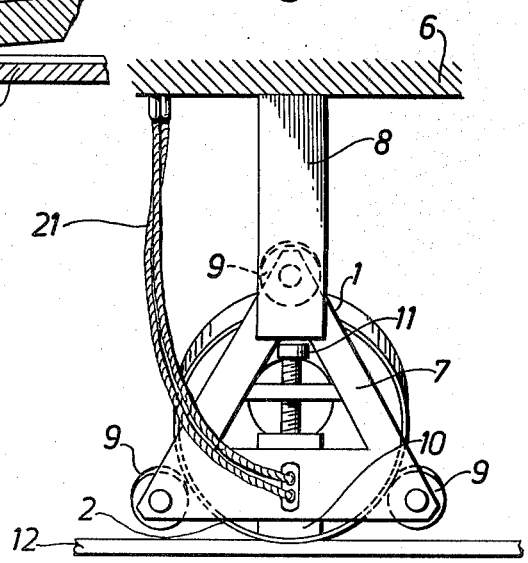
FIG. 3 is a front view of the arrangement in accordance with the invention that is to say a view from the side from which the material is supplied.

At the free end of the cylindrical cutter 1 there is a supporting unit 7 which via a fastener 8 is also attached and supported by the frame 6. The supporting unit 7 is provided with a number of backing rollers 9 supported so that they can freely rotate which surround the cylindrical cutter and rest against its outer cylindrical surface at a small distance inside the cutting edge 2. The supporting element 7 (FIG. 3) is of a substantially triangular shape, a backing roller being arranged at each point of the triangle. Between the two lower backing rollers 9 (that is to say the backing rollers located closest to the material web 12) the supporting unit 7 supports a guiding device 10. A setscrew 11 enables the guiding device 10 to be adjustable in radial direction of the cylindrical cutter towards or away from the cutting edge 3. This is made possible by the guiding device 10 being supported so that it can slide in a part of the supporting unit 7 which is situated between the two backing rollers 9 located closest to the material web 12 worked. As is evident in particular from FIG. 1, the material web 12 passes over two guide rolls 13, 14, the arrangement in accordance with the invention being located so that the working of the material web 12 takes place between the two rolls 13 and 14.

Figure 2:
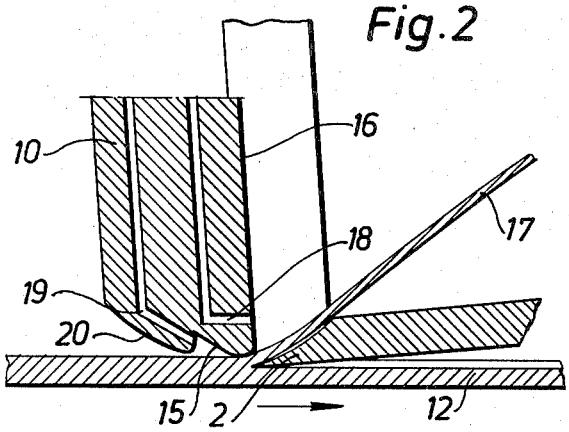
FIG. 2 is an enlarged side view partly in section of a part of the arrangement in accordance with FIG. 1.

With reference now to FIG. 2 an enlarged part of the guiding device 10 is upheld by the supporting unit 7. The guiding device 10 is of an elongated form and extends downwards in radial direction of the cylindrical cutter 1. The end of the guiding device 10 facing the cutting edge 2 comprises a working surface 15 which forms an acute angle with the material web 12. The working surface is substantially of the same width as the material strip which is to be cut away, but may also be somewhat wider. Seen in transverse direction of the web the working surface is somewhat curved with a radius which substantially corresponds to the radius of the cutter. The working surface 15 which is polished to a very fine surface finish, extends to the plane side 16 of the guiding device 10 facing the cylindrical cutter and terminates at the same level as the knife edge. The said side of the guiding device 10 is located in the same plane as the cutting edge 2. The distance between the working surface 15 (more particularly the edge formed between the working surface 15 and the side 16 of the guiding device) and the cutting edge 2 determines the depth of cut, that is to say the amount of material web 12 which is to be cut away with the help of the rotating cylindrical cutter 1. The cutting edge 2 is ground on the side facing towards the inside of the rotating cylindrical cutter 1 and cuts away during the working a material strip 17 which by means of a device (not shown) and a forceful current of air is removed through the hollow cutter shaft 3 to some collecting point. To facilitate the removal of the material strip 17 from the cutting place, the guiding device 10 may be provided with an air outlet 18 which during operation, thanks to an ejector effect, creates a lifting force which propels and guides the material strip 17 in the direction away from the cutting edge 2. The guiding device 10 is also provided with a further air outlet 19 which is arranged in a projection 20 directly in front of the working surface 15. With the help of the air outlet 19 the working surface 15 can be cooled, at the same time as the current of air diminishes the friction between the working surface and the material web 12, which is valuable at high production speeds. The air outlets 18 and 19 are connected via air hoses 21 to a source of compressed air (not shown).

FIG. 1 shows how the arrangement in accordance with the invention is situated during the working of the material web. The cylindrical cutter 1 is with its center axis substantially in the direction of movement of the web 12, but the center axis is slightly skewed, so that the end of the cylindrical cutter 1 provided with the cutting edge 2 comes to rest against the material web 12 moving between the rolls 13 and 14. More particularly, the active part of the cutting edge 2 facing towards the material web 12 extends a little below the straight plane wherein the material web 12 would run between the rolls 13 and 14, if it were not acted upon by the cylindrical cutter. As a result, the material web 12 will be pressed against the working surface 15 of the guiding device 10 during the whole period of operation, so that the distance between the working surface 15 and the cutting edge 2 alone will determine the thickness of the material strip 17 cut away and hence the thickness of the reduced, longitudinal region of the material web 12. Since only approx. 0.25 mm of the original total thickness of 0.5 mm of the material web are to be cut off, the guiding of the material web 12 past the cutting edge 2 is very critical. However, experiments have shown that the initial stress of the material web 12 which is caused by the cylindrical cutter 1, as well as the guiding device 10, being moved slightly down between the rolls 13 and 14, is sufficient to ensure that under all normal working conditions such a contact pressure of the material web 12 against the working surface 15, that the thickness of the material strip 17 cut away can be maintained and controlled wholly by the distance between working surface and cutting edge 2. To ensure that the thickness of the material strip 17 cut away corresponds to the distance between the working surface 15 and the cutting edge 2 it is also very important, especially at high feed velocities of the material web 12, that the material web rests only against the part of the working surface 15 situated closest to the cutting edge 2, since otherwise, that is to say if the material web 12 were to rest against the working surface 15 at a distance in front of the cutting edge 2, the material web 12 would be pressed away from the cutting edge 2 so that the thickness of the material strip 17 would become less than the distance between working surface and cutting edge. Similar effects have been observed in experiments with rotating guiding devices, since the diameters of these cannot be made sufficiently small to ensure that the material web rests against the guiding device only in a very limited area closely in front of the cutting edge.

In the operation of the arrangement in accordance with the invention the material web 12 is fed at a typical speed of between 300 and 400 m/minute, at the same time as the cylindrical cutter 1 rotates at a speed of 800 revolutions per minute (corresponding to a peripheral speed at the cutting edge 2 of approx. 50 m/minute). At such high speeds of the material web as well as of the cutter it is of the greatest importance that all types of vibrations are prevented. Hence the support of the cylindrical cutter 1 is important, as is also the support of the rolls 13 and 14. However, in spite of the maximum possible accuracy, it is not possible to prevent a certain vibration in the cylindrical cutter during operation. In earlier designs this vibration proved to render impossible the maintaining of a uniform depth of cut at such high speeds, but the arrangement in accordance with the invention overcomes these problems. Beside the guiding device 10 described earlier and the special design of the same as well as of its working surface 15, the arrangement in accordance with the invention also provides a system which on the one hand reduces the vibrations arising and on the other hand eliminates the effect of the residual vibrations on the thickness of the material strip 17 cut away. The firstmentioned is achieved because the supporting element 7, upholding the guiding device 10, rests with the help of the backing rollers 9 against the peripheral surface of the cylindrical cutter in the vicinity of the free end of the cutter provided with the cutting edge 2. The backing rollers 9 act here as a support for the free end of the cylindrical cutter and prevent the same from any radial movement, irrespectively of whether such a radial movement is due to inaccuracies in the bearing 4 or to the influence of the cutting edge 2 in the cutting of the material web. This design has proved to contribute effectively to a quieter and more uniform running. The residual vibrations are very small but may, in view of the extremely narrow tolerances existing, have a negative effect on the depth of cut. By coupling together the cylindrical cutter 1 and the supporting unit 7 with the help of the backing rollers 9, however, the guiding device 10 becomes positively linked with the cylindrical cutter 1 and moves in rhythm with the same, so that the distance between the working surface 15 and the cutting edge 2 is securely maintained with great accuracy, independently of radial movements of the cutter. Since the material web rests against the working surface 15 with a certain initial stress, uniform movements of working surface 15 and cutting edge 2 will have no effect on the depth of cut, since they are exclusively determined by the free distance between working surface and cutting edge. Thus a uniform depth of cut is assured even if minor vibrations cannot be wholly prevented during operation at high speed.

While a preferred embodiment of this invention has been illustrated and described in this specification, it is recognized that variations and changes may be made therein without departing from the invention, as set forth in the claims.

We claim:

1. Apparatus for reducing the thickness of a moving material web comprising:

rotating cylindrical cutting means for cutting a strip from the material web, said cutting means having a circular cutting edge;

guide means for controlling the thickness of said strip; and support means for supporting said cutting means adjacent said cutting edge, said guide means being mounted on said support means and said guide means having a working surface adjacent said cutting edge, whereby both the cylindrical cutting means and the guide means being supported on the support means assure a substantially constant distance between said cutting edge and said working surface.

2. The apparatus of claim 1 wherein the rotating cutting means is disposed on one side of the material web and has an axis of rotation substantially in a direction of movement of the material web.

3. The apparatus of claim 1 wherein the support means includes a plurality of backing rollers which contact a surface of the cylindrical cutting means.

4. The apparatus of claim 1 wherein the guide means further includes adjusting means for adjusting the position of the working surface relative to the cutting edge.

5. The apparatus of claim 1 wherein the working surface forms an acute angle with the material web and wherein the working surface is approximately as wide as the strip cut from the material web and wherein the working surface has a radius of curvature equal to a radius of curvature of said circular cutting edge.

6. The apparatus of claim 1 wherein the guide means has means for supplying fluid to cool the gliding surface.

7. The apparatus of claim 1 wherein the guide means has means for supplying fluid to guide the strip cut from the material web away from the cutting edge.

8. Apparatus for reducing the thickness of a moving material web along a longitudinal region comprising:

a rotating hollow cylindrical cutter having a circular cutting edge;

mounting means for mounting said cutter for rotation about an axis, said cutting edge being concentric with said axis;

a guiding device having a working surface;

support means for mounting said working surface adjacent said cutting edge, said guiding device including a first fluid outlet for directing fluid to cool the working surface, and a second fluid outlet for directing fluid to guide away material cut from the web; and material advancing means for advancing a web of material in contact with said gliding surface and said cutting edge, whereby a strip of material of substantially uniform thickness is cut from the material web as it advances past said cutting edge.

9. The apparatus of claim 8 wherein said supporting means maintains said working surface in a substantially fixed position relative to said axis of rotation of said cutter, said working surface being curved and being substantially concentric with said circular edge.

10. The apparatus of claim 8 wherein said supporting means includes a frame upon which the guiding device is adjustably mounted, said mounting means being on said frame and said mounting means including a plurality of backing rollers which contact an outer surface of the rotating hollow cylindrical cutter, whereby the position of said guiding device and said backing rollers are fixed in relation to each other.

11. Apparatus for reducing the thickness of a moving material web in a region of the material web comprising:

a rotating hollow cylindrical cutter having a circular cutting edge, said cutter being arranged on a first side of the material web and having an axis of rotation, said cutting edge being concentric with said axis;

a guiding device, having a gliding surface, which guides the cutter;

a support frame on which the guiding device is adjustably mounted, said frame including a plurality of backing rollers which contact an outer surface of said cutter; and material advancing means for advancing the material web in contact with said gliding surface and said cutting edge, whereby a strip of material of substantially uniform thickness can be cut from the moving material web as it advances past said cutting edge.

* * * * *